United States Patent [19]

Rusinyak

[11] Patent Number: 4,674,641

[45] Date of Patent: Jun. 23, 1987

[54] TAMPER-EVIDENT CLOSURE CAP

[76] Inventor: Greg Rusinyak, 7087 Walker Rd., Bozeman, Mont. 59715

[21] Appl. No.: 879,932

[22] Filed: Jun. 30, 1986

[51] Int. Cl.[4] ..... B65D 55/02

[52] U.S. Cl. ..... 215/230

[58] Field of Search ..... 215/230

[56] References Cited

U.S. PATENT DOCUMENTS

| | | | |
|---|---|---|---|
| 2,939,597 | 6/1960 | Greene | 215/230 |
| 3,073,468 | 1/1963 | Arneson | 215/230 |
| 4,519,515 | 5/1985 | Schonberger | 215/230 |

*Primary Examiner*—Donald F. Norton

*Attorney, Agent, or Firm*—Richard C. Conover

[57] ABSTRACT

A tamper-evident closure lid for a container which includes a cap assembly having a movable indicator slide or rotatable indicator arm which in one position indicates the container is "sealed" and in another position indicates the container has been "opened". Resilient means are provided for moving the indicator member to the "opened" position when the container is opened. Further, locking means are provided for retaining the indicator member in the "opened" position once the container has been opened.

10 Claims, 10 Drawing Figures

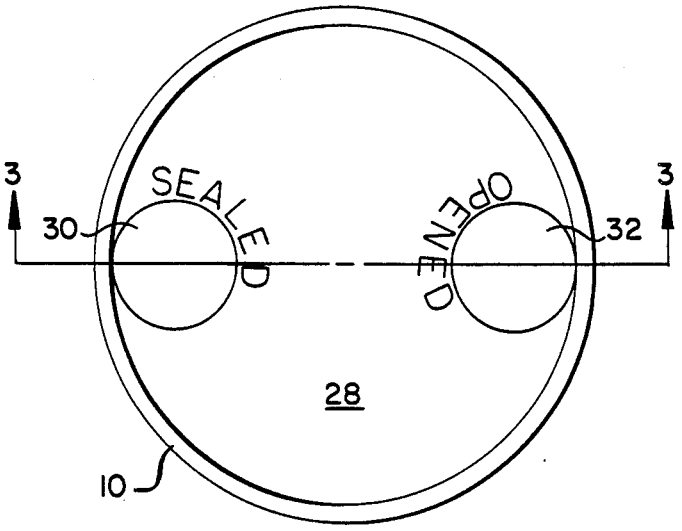
FIG. 1
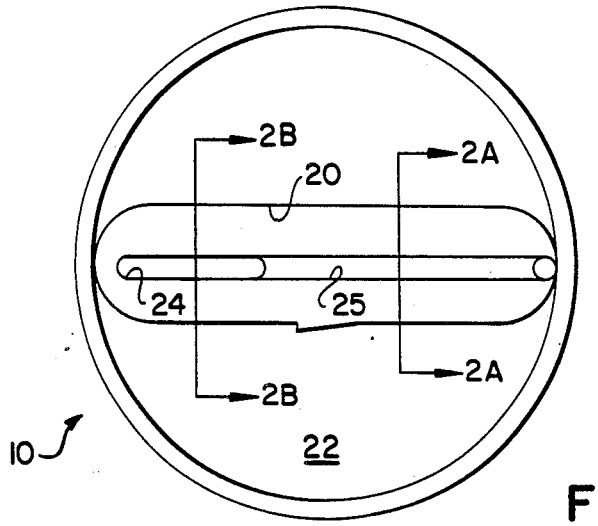
FIG. 2
FIG. 2B
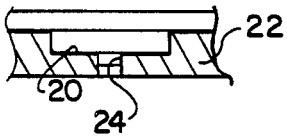
FIG. 2A
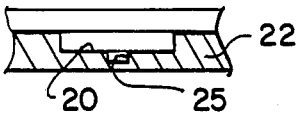

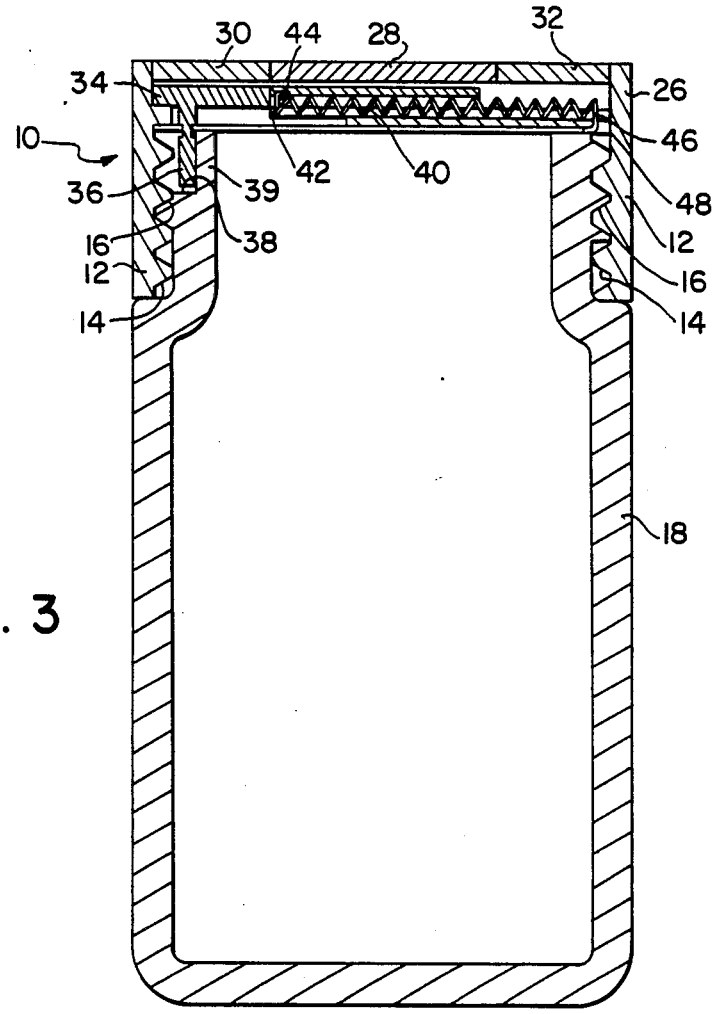
FIG. 3
FIG. 4
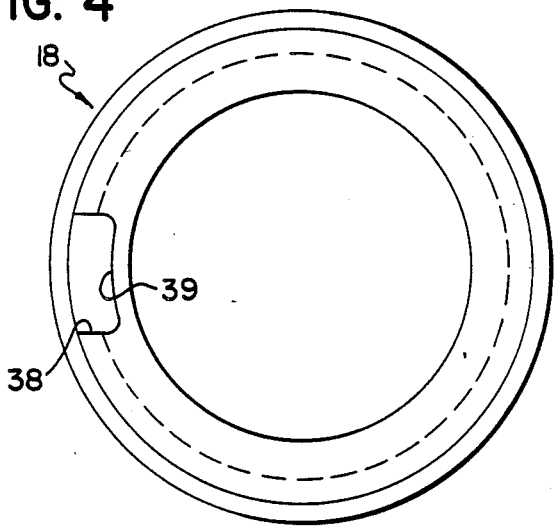
FIG. 5
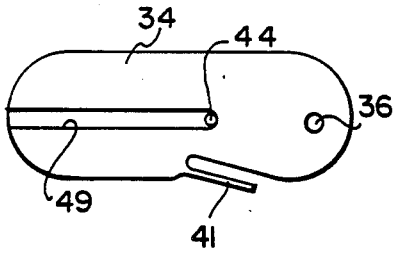

TAMPER-EVIDENT CLOSURE CAP

BACKGROUND OF INVENTION

This invention relates to a tamper-evident lid to be used with a container such that upon removal of the lid from the container, the fact of such removal is visually indicated. The present invention provides a closure cap which will automatically provide an indication of attempts to open the container and attempts to replace the container with a different container. This invention has particular utility in the container industry to prevent consumers from being injured by contaminated products which are inserted in containers after the manufacturing and packaging processes.

There are a number of various types of tamper-evident container lids which are known. One type of container lid contains a dye in capsules which are ruptured upon turning the lid. This is illustrated by U.S. Pat. No. 4,519,515 to Schonberger.

Another type of container lid is shown in U.S. Pat. No. 3,073,468 to Arneson which describes a mechanical type tamper-evident closure lid. In this device, once the closure cap is turned to open the closure lid, the device indicates that a attempt has been made to rotate the lid in this opening direction. All of these known mechanical type lid assemblies, however, only provide an indication that a closure lid has been rotated in the container opening direction.

A major disadvantage of the mechanical type closures such as illustrated in the Arneson reference is that no indication of tampering is provided when the container is broken away from the closure cap and a new container, possibly with a contaminated product, is inserted in place of the original container.

SUMMARY OF INVENTION

In accordance with the present invention, a closure lid is provided which indicates when a container has been opened regardless of whether the container has been opened in a normal manner or the container has been broken away from the closure lid and a replacement container inserted in the closure lid. The present invention is an improvement on the tamper-evident closure caps now known in the art.

The closure lid, according to one embodiment of the present invention, includes a cap assembly which is secured to a container with conventional apparatus such as screw type threads. This cap assembly has a transverse groove formed in a cover portion of the cap assembly to receive an indicator slide element. The indicator slide is sized to slide in the slot provided in the cover portion between a first and a second position, one indicating that the container is "sealed" and the other position indicating that the container has been "opened". At the bottom of the indicator slide is attached a shear tab which is inserted in an opening provided in the neck of the container with which the cap assembly is to be used. In addition, an extension spring is used to normally bias the indicator slide to the "opened" position. When the container is sealed, the indicator slide is moved to the "sealed" position against the bias of the spring and the shear tab is placed in the opening in the container neck. The indicator slide is then retained in this position by a wall of the opening provided within the interior of the container. Upon moving the cap in either direction, the shear tab is sheared off and the extension spring then causes the slide indicator to move to the "opened" position. Further when the container is broken away from the closure lid, the indicator slide moves to the "opened" position even though the shear tab is not sheared. When this happens, a new container cannot be used to replace the original container because when this is done, the shear tab is sheared and the indicator slide cannot be returned to the "sealed" position.

In an improved embodiment a locking tab is further provided on the indicator slide which cooperates with a notch on the cap assembly to prevent positively the indicator slide from moving to the "sealed" position once it has moved to the "opened" position.

Finally, a top cap cover is provided with a window positioned over the indicator slide in the "sealed" position and also another window over the slide in the "opened" position. If, for example, the indicator slide is colored red, there is a visual indication that the container is sealed when the container has not been opened, and when it has been opened, there is a visible indication that the container has been opened.

BRIEF DESCRIPTION OF THE DRAWINGS

In order that the invention may be clearly understood and readily carried into effect a preferred embodiment will now be described, by way of example only, with reference to the accompanying drawings wherein:

FIG. 1 is a top view of the closure lid in accordance with the present invention;

FIG. 2 is a top view of the cap assembly in accordance with the present invention;

FIG. 2A is a partial cross-sectional view of the cap assembly shown in FIG. 2 along line 2A—2A in FIG. 2.

FIG. 2B is a partial cross-sectional view of the cap assembly shown in FIG. 2 along line 2B—2B in FIG. 2.

FIG. 3 is a cross-sectional view along the line 3—3 in FIG. 1;

FIG. 4 is a top view of the container shown in FIG. 3;

FIG. 5 is a detail bottom view of the indicator slide with shear tab shown in FIG. 3;

DESCRIPTION OF PREFERRED EMBODIMENTS

Figure 6:
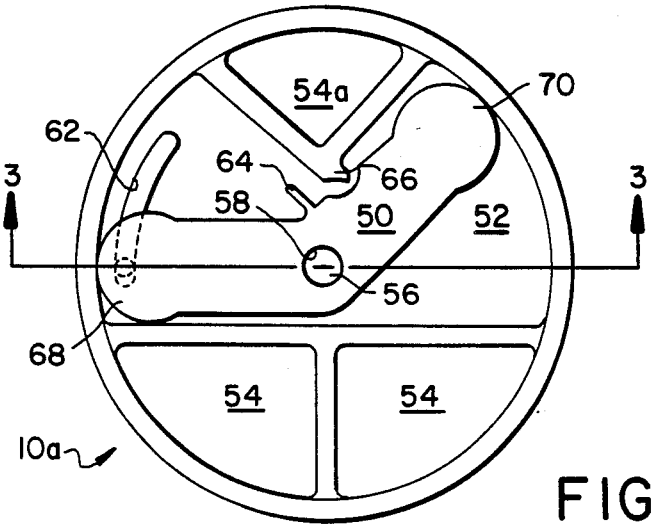
FIG. 6 is a top view of a second embodiment of the present invention with the top closure cover removed.

The closure lid, according to a first embodiment of the present invention, includes a cap assembly 10 as shown in FIGS. 1, 2 and 3. This cap assembly has a depending cylindrical and hollow portion 12 which has interior threads 14 for threadable insertion on a threaded neck 16 of a container 18 to be capped. The cap assembly 10 further has a transverse groove 20 formed on a cover portion 22 of the cap assembly 10 as shown in FIG. 2 and extends across the entire cap assembly 10. The groove 20 having a first end and a second end at the extremities thereof. As shown in FIG. 2 and 2B a slot 24 is formed in groove 20 and in a direction parallel to the longitudinal axis of groove 20 which slot extends through the cover portion 22 and from a position adjacent the first end of groove 20 longitudinally towards the second end of groove 20. As shown in FIGS. 2 and 2A, the slot 24 extends into a recessed groove 25 which extends to the second end of groove 20.

The cover portion 22 is recessed and a lip 26 is formed on the rim of the cap assembly 10 which extends circumferentially around the cap assembly and is formed and sized to receive a closure top cover 28, as shown in FIG. 3.

An indicator slide 34 for visually indicating whether the container has been opened or is sealed is shown in FIGS. 3 and 5. This indicator slide is sized to slidably move in groove 20 between the first end and the second end of the groove. The indicator slide 34 further includes a shear tab 36 which is secured to the indicator slide 34 and extends in a direction perpendicular to the exterior surface of the indicator slide as shown in FIG. 3. The shear tab 36 is constructed so that it can be sheared away from the indicator slide 34 when shear pressure is applied to the shear tab 36.

The container 18 which has the threaded neck 16, further includes an opening 38 as shown in FIGS. 3 and 4 formed in the wall of the neck 16 of the container adjacent the mouth of the container 18. This opening 38 opens through the mouth and outwardly but the inner wall of the neck extends to the mouth to provide a stop 39. The shear tab 36 is positioned in this opening 38 as shown in FIG. 3 when the container is sealed.

An extension spring 40 is also provided which has a first hook end 42 which may be inserted in a hole 44 provided in the indicator slide 34 as shown in FIG. 5 and further has a second hook 46 located at the opposite end of the extension spring 40 for insertion in hole 48 provided in the cover portion 22 of the cap assembly 10, as shown in FIG. 2. This extension spring 40 normally biases the indicator slide 34 toward the second end of groove 20 but the shear tab 36 located in opening 38 prevents the indicator slide 34 from moving to the second position since the stop 39 prevents the shear tab 36 from moving in this direction until the container 18 is opened as well a subsequently described.

To assemble the tamper-evident container lid according to the present invention, the cap assembly 10 is first threadably inserted on the container 18. The cap assembly is then tightened on the neck 16 and the outer end of slot 24 is positioned above the opening 38 formed in the neck of the container 18. Next the spring 40 is inserted with the hook 42 in the hole 44 and the hook 46 in the hole 48 and the indicator slide 34 positioned with the shear tab 36 in the opening 38 of the container 18. The spring is inserted in a groove 49 provided in the indicator slide 34 as shown in FIG. 5 such that the indicator slide 34 rests within the groove 20 of the cap assembly 10. The shear tab 36 also extends through the slot 24 in the groove 20 and as said before rests in the opening 38 of the neck 16. In this position, the indicator slide 34 is held in the first or "sealed" position by the cooperation of shear tab 36 and stop 39.

Once this has been completed, the top cap closure 28 is next inserted within the recess formed on the cap assembly 10. The top cap closure 28 is provided with a pair of windows 30 and 32 as shown in FIGS. 1 and 2. The window 30 is positioned over the indicator slide 34 in the "sealed" position, and the top cover 28 bonded to the cap assembly 10 as with an adhesive. In a preferred embodiment the indicator slide is colored red so that a red color appears under the window 30 when the container is "sealed". The window 32 is positioned to be over the indicator slide in the "opened" position. When the indicator slide 34 is moved to this position, a red color appears in window 32.

As will be realized by referring to FIGS. 3 and 4, the shear tab 36 will be sheared when the closure lid is rotated in either a clockwise or a counterclockwise direction by the shear pressure applied through the walls of opening 38. For example, when the container is opened by rotating the cap assembly 10 in the counterclockwise direction, the shear tab 36 will be sheared. When this happens, the indicator slide 34 will be forced under bias of the spring 40 to move in the groove 20 to the second or "opened" position in the groove 20. This positions the colored indicator slide 34 under the window 32 of the top cover 28, thus indicating that the container has been "opened".

It can also be readily ascertained that even if the container 18 were broken away from the closure lid with the indicator slide 34 in the "sealed" position and a new container placed in the closure lid, the shear tab 36 would mos likely be sheared by compressing the bottom of the shear tab 36 on the top of the mouth of the container being inserted or by the shear tab 36 falling into the opening 38 of the container and being sheared by further rotation of the container.

An improved version of this embodiment is constructed with apparatus for preventing the indicator slide 34 from moving back to the "sealed" position once it has been moved to the "opened" position. This is accomplished by forming a locking tab 41 on the indicator slide 34 as shown in FIG. 5 and providing a notch 43 on the cap assembly 10 as shown in FIG. 2. The locking tab 41 and notch 43 cooperate so that when the indicator slide 34 moves from the "sealed" position to the "opened" position, the indicator slide 34 is prevented from returning to the "sealed" position by locking tab 41 engaging notch 43.

Thus, the present invention provides a tamper-evident cap assembly which provides a visual indication whether the container has been opened prior to a user first opening the container. Further, the present invention provides a visual indication as to whether a different container has been inserted in the closure lid prior to a user first opening the container.

The important consideration for a user is to determine whether the indicator slide 34 is under the "sealed" window 30 before opening the container 18 and whether the indicator slide 34 moves from the "sealed" position to the "opened" position when the container 18 is first opened. This particular invention is helpful because when a user does buy a product in a container having a closure according to the present invention, the user can be sure that the user is the same and has not been opened if the indicator slide is in the "sealed" position and moves to the "opened" position when the container is first opened. If these two things do not occur, then the user will realize that a container may have been tampered with.

Figure 7:
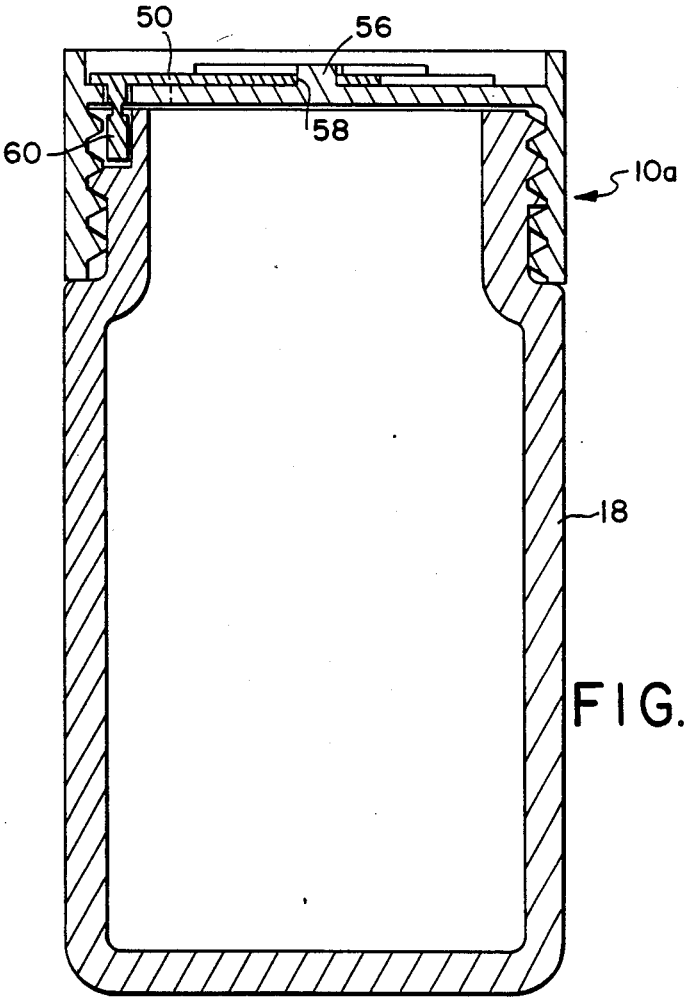
FIG. 7 is a cross-sectional view along line 7—7 in FIG. 6.

A second embodiment of the present invention is shown in FIGS. 6 and 7. In this embodiment of the invention, a spring is not used to move a slide element from a "sealed" indicating position to an "opened" indicating position. In this embodiment, an indicator arm 50 as shown in FIG. 6 is used. The same top cover 28 as shown in FIG. 1 is used on a cap assembly **10*a* of this embodiment. This cap assembly 10*a*, however, is constructed differently than the cap assembly 10 of the first embodiment. This cap assembly 10*a* has a recess 52 in which the indicator arm 50 is positioned and also has bonding surfaces 54 which are used to bond the top cover 28 onto the cap assembly 10***a*. The cap assembly 10*a* further has an upright post 56 which is centrally mounted in the cap assembly 10*a*. A bore 58 is provided on the indicator arm 50 as shown in FIG. 7. The post 56 is slideably received by the bore 54 so that indicator arm 50 is rotatably mounted on the cap assembly 10*a*. The indicator arm 50 as shown in FIG. 6 further has a shear tab 60 which is transversely mounted at one end of the indicator arm 50 as shown in FIGS. 6 and 7 and is inserted in an arcuate slot 62 formed in the recess 52 of the cap assembly 10*a*.

The indicator arm 50 further has a locking tab 64 which is bendable and can cam over a locking projection 66 formed on the bonding surface 54*a* secured to the cap assembly 10*a*.

In this embodiment, the cap assembly 10*a* is first threadably mounted on the neck of the container as before, the indicator arm 50 is then placed on the cap assembly 10*a* by aligning the bore 58 with the post 56 and the shear tab 60 in the arcuate slot 62. In this position, the indicator arm has a "sealed" indicating end portion 68 positioned as shown in FIG. 6 and an "opened" indicating portion 70 which is also positioned as shown in FIG. 6. Once the indicator arm 50 is in place, the top cover 28 is then bonded to the bonding surfaces 54 of the cap assembly 10*a* with the window 30 positioned over the "sealed" indicating portion 68.

Once this has been done, any attempt to open the container 18 by rotation of the cap assembly 10*a* in a counterclockwise direction will cause the shear tab 60 to rest against the right-hand wall of opening 38 in the container 18 and slide in arcuate slot 62 provided in cap assembly 62. The bending strength of locking tab 64 is chosen to be less than the shear point of shear tab 60 so that upon such rotation of cap assembly 10*a*, the locking tab 64 will cam over locking projection 66 whereby the "opened" indicating position 70 of indicator arm 50 will be positioned under window 32. In this position the indicator arm 50 will be prevented from returning to the "sealed" position by locking tab 64 and locking projection 66. Upon further rotation of the cap assembly 10*a*, the tab 60 will be sheared off by the shear pressure provided by the action of the lefthand wall of arcuate slot 62 on shear tab 60 abutting the right-hand side of opening 38 in the container 18.

In this embodiment, there is no spring to cause an indicator slide to move from a sealed position to an opened position. In this embodiment if the indicator arm is in the "sealed" position, it is important for the user to make sure that when the container is first opened, the indicator arm moves from the "sealed" to the "opened" position. If there is no such movement, then the container may have been tampered with. An example of this would be when the indicator arm is in the sealed position and the container is broken away from the cap assembly and a new container inserted in the cap assembly. In this situation, when the new container is inserted, the tab 60 will be sheared off by the top surface of the mouth of the new container and the indicator will still show that the container is "sealed". However, when the container is opened for the first time by the user, the indicator will not move from the sealed to the opened position because no tab is there to cause the camming movement of the locking tab 64 over the locking projection 66. Thus it is necessary for the user to realize that the indicator arm must be in the "sealed" position when it is sealed and it must be in the "opened" position when it is opened and when the container is opened for the first time, the indicator arm moves from the "sealed" position to the "opened" position. Once this is observed, the user can be fairly confident that the container has not been tampered with prior to the user opening the container.

Figure 8:
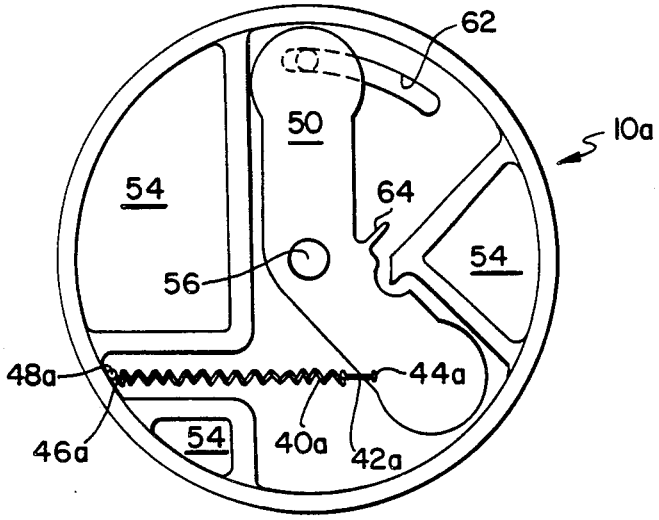
FIG. 8 is a top view of a third embodiment of the present invention with the top closure cover removed.

A third embodiment of the present invention is shown in FIG. 8. This embodiment is similar to the second embodiment shown in FIGS. 6 and 7 except that an extension spring 40*a* is provided to positively rotate the indicator arm 50 when the shear tab 60 is sheared off by rotation of cap assembly 10*a*. As with the first embodiment extension spring 40*a* has a first hook 42*a* at one end for insertion in a hole 44*a* provided in the indicator arm 50 and a second hook 46*a* at the other end for insertion in a hole 48*a* provided in the cap assembly 10*a*. The resilient strength of the spring 40*a* is chosen to be greater than the bending strength of locking tab 64 as shown in FIG. 8 so that if the shear tab 60 is sheared, the indicator arm 50 will be rotated and locking tab 64 will cam over locking projection 66 in a manner described previously with respect to FIGS. 6 and 7, but this time under the positive force of spring 40*a*. Hence with this embodiment, once the shear tab 60 is sheared for any reason, the indicator arm 50 will move to the "opened" position under window 32 of the closure cover 28.

While the fundamental novel features of the invention have been shown and described, it should be understood that various substitutions, modifications and variations may be made by those skilled in the art without departing from the spirit or scope of the invention. Accordingly, all such modifications and variations are included in the scope of the invention as defined by the following claims.

I claim:

1. A tamper-evident closure lid for a container having a neck terminating in a container mouth, the neck having a closure lid securing means thereon for securing the closure lid over the mouth of the container comprising:

(a) a cap assembly having means for cooperating with the securing means for removably securing the closure lid to the container;

(b) the cap assembly being adapted to receive an indicator member mounted thereon;

(c) the indicator member being constructed to move from a first position to a second position on the cap assembly;

(d) a resilient means connected between the indicator member and the cap assembly normally biasing the indicator member toward the second position; and (e) the indicator member further having disengageable means for disengageably cooperating with stop means formed on the container to hold the indicator member in the first position, the disengageable means adapted to disengage from the stop means and to release the indicator member upon rotation of the cap assembly with respect to the container in a plane parallel to the mouth of the container and also upon separation of the disengageable means from the stop means;

(f) a top cover having a first window positioned above the first position of the indicator member and a second window positioned above the second position of the indicator member, the top cover being bonded to the cap assembly after the indicator member is positioned in the first position with the releasable means in cooperative relation with the stop means formed on the container.

2. A tamper-evident closure lid for a container having a neck terminating in a container mouth, the neck having a closure lid securing means thereon for securing the closure lid over the mouth of the container comprising:

(a) a cap assembly having a hollow depending portion with means for cooperating with the securing means for removably securing the closure lid to the container and further having a cover portion covering the hollow depending portion;

(b) the cover portion being adapted to receive an indicator slide;

(c) the indicator slide being constructed to slide from a first position to a second position on the cap assembly;

(d) a resilient means attached between the indicator slide and the cap assembly normally biasing the indicator slide towards the second position;

(e) the container being provided with stop means for cooperating with a shear tab secured to the indicator slide to prevent movement of the indicator slide from the first position to the second position;

(f) the shear tab having one end secured to the indicator slide and having a second end positionable to operatively cooperate with the stop means to hold the indicator slide in the first position, the shear tab being adapted to disengage from the stop means and to release the indicator slide when the cap assembly is rotated with respect to the container in a plane parallel with the mouth of the container and also upon separation of the shear tab from the stop means; and (g) a top cover having a first window positioned above the first end of the groove and a second window positioned above the second end of the groove, the top cover being bonded to the cap assembly after the indicator slide is positioned in the groove with the shear tab portion in the opening provided in the wall of the neck of the container.

3. The tamper-evident closure lid according to claim 2 wherein the indicator slide further includes a locking tab means for cooperating with a notch means provided on the cap assembly to prevent movement of the indicator slide from the second position to the first position.

4. The tamper-evident closure lid according to claim 2 wherein the stop means comprises an opening formed in the neck of the container which opening opens into the mouth of the container but which opening is partially defined by an interior wall of the neck extending to the mouth and wherein the second end of the shear tab extends into the opening whereby the indicator slide is prevented from moving to the second position under the influence of the resilient means.

5. The tamper evident closure lid according to claim 4 wherein the cover portion includes a transverse groove formed thereon for receiving the indicator slide, the groove further including a slot formed in the groove which extends through the cover portion and wherein the indicator slide is sized to slide in the groove between a first end of the groove corresponding to the first position of the indicator slide and a second end of the groove corresponding to the second position of the indicator slide, and wherein the second end of the shear tab is positionable through the slot formed in the groove and into the opening formed in the neck of the container.

6. A tamper-evident closure lid for a container having a neck terminating in a container mouth, the neck having a closure lid securing means thereon for securing the closure lid over the mouth of the container comprising:

(a) a cap assembly being cylindrical in construction and having a hollow depending portion with means for cooperating with the securing means for removably securing the closure lid to the container and further having a cover portion covering the hollow depending portion;

(b) The cap assembly being removable from the neck of the container by rotation of the cap assembly in a first sense and the cap assembly being insertable on the neck of the container to close the mouth of the container by rotation of the cap assembly in a second opposite sense;

(c) the cover portion being adapted to receive an indicator arm;

(d) the indicator arm being rotatably mounted on the cap assembly and moveable from a first position to a second position;

(e) the container having a shearing means for shearing a shear tab secured to the indicator arm;

(f) the shear tab having a first end secured to the indicator arm and a second end positionable to operatively cooperate with the shearing means when the indicator arm is in the first position, the shearing means being adapted to shear the shear tab when the cap assembly is rotated with respect to the container in a plane parallel with the mouth of the container;

(g) the indicator arm further having a bendable locking tab secured thereto;

(h) the cap assembly further having a locking projection adapted for cooperating with the locking tab such that upon rotation of the cap assembly in the first sense the locking tab will cam over the locking projection before the shear tab is sheared to permit the indicator arm to move from the first position to the second position and whereupon further rotation of the cap assembly in the first sense will cause the shear tab to be sheared and whereupon subsequent rotation of the cap assembly in either the first or second sense the locking tab will prevent the indicator arm from moving back to the first position;

(i) a top cover having a first window positioned above the indicator arm to allow visual observance of the indicator arm in the first position and a second window positioned above the indicator arm to allow visual observance of the indicator arm in the second position, the top cover being bonded to the cap assembly after the indicator arm is located in the first position.

7. The tamper-evident closure lid according to claim 6 wherein the shearing means further includes means for operatively engaging the shear tab to impede movement of the indicator arm from the first position to the second position and wherein the closure lid further includes resilient means connected between the indicator arm and the cap assembly normally biasing the indicator arm toward the second position, the resilient strength of the resilient means being less than the shearing strength of the shear tab whereupon only when the shear tab is sheared or the shear tab removed from operative engagement with the shearing means will the indicator arm move to the second position under force of the resilient means.

8. The tamper-evident closure lid according to claim 6 wherein the shearing means includes peripheral walls of an opening formed in the neck of the container adjacent the mouth of the container.

9. The tamper-evident closure lid according to claim 8 wherein the cover portion includes a recess on a top portion opposite the hollow depending portion, the recess further including an arcuate slot comprising a portion of an annulus of the cap assembly adjacent an exterior wall of the cap assembly and further wherein the indicator arm is positioned in the recess and wherein further the shear tab is positionable through the arcuate slot and into the opening and in which position the shear tab in cooperation with the walls of the opening impede movement of the indicator arm from the first position to the second position.

10. A tamper-evident closure cap for a container having a neck terminating in the container mouth, the neck having a closure cap securing means thereon for securing the closure cap over the mouth of the container comprising:

(a) a cap assembly having means for cooperating with the securing means for removeably securing the closure cap to the container;

(b) the cap assembly being removeable from the neck of the container by rotation of the cap assembly in a first sense and for closure of the mouth in a second opposite sense;

(c) the cap assembly being adapted to receive an indicator arm;

(d) the indicator arm being rotatably mounted on the cap assembly and moveable from a first position to a second position on the cap assembly;

(e) the indicator arm having engaging means for disengageably cooperating with stop means formed on the container, the engaging means being disengageable from the stop means when the cap assembly is rotated with respect to the container in a plane parallel with the mouth of the container and also when the engaging means are separated from the stop means;

(f) the indicator arm further having a bendable locking tab secured thereto;

(g) the cap assembly further having a locking projection adapted for cooperating with the locking tab such that upon rotation of the cap assembly in the first sense, the locking tab will cam over the locking projection before the engaging means disengages from the stop means to permit the indicator arm to move from the first position to the second position and whereupon further rotation of the cap assembly in the first sense will cause the engaging means to be disengaged from the stop means and whereupon subsequent rotation of the cap assembly in either the first or second sense, the locking tab will prevent the indicator arm from moving back to the first position;

(h) a top cover having a first window positioned above the indicator arm to allow visual observance of the indicator arm in the first position and a second window positioned above the indicator arm to allow visual observance of the indicator arm in the second position, the top cover being bonded to the cap assembly after the indicator arm is located in the first position.

* * * * *